US008802949B2

(12) United States Patent
Antaki

(10) Patent No.: US 8,802,949 B2
(45) Date of Patent: Aug. 12, 2014

(54) PITCH ALTERING MECHANISM FOR REEDED INSTRUMENT

(75) Inventor: James F. Antaki, Pittsburgh, PA (US)

(73) Assignee: James F. Antaki, Pittsburgh, PA (US)

( * ) Notice: Subject to any disclaimer, the term of this patent is extended or adjusted under 35 U.S.C. 154(b) by 674 days.

(21) Appl. No.: 12/815,710

(22) Filed: Jun. 15, 2010

(65) Prior Publication Data

US 2011/0303072 A1 Dec. 15, 2011

(51) Int. Cl.
*G10D 7/10* (2006.01)

(52) U.S. Cl.
USPC ..... 84/377

(58) Field of Classification Search
USPC ..... 84/330, 377–379, 363
See application file for complete search history.

(56) References Cited

U.S. PATENT DOCUMENTS

| | | | | |
|---|---|---|---|---|
| 574,625 | A | | 1/1897 | Paris |
| 1,671,309 | A | | 5/1928 | Newman |
| 1,752,988 | A | | 4/1930 | Haussler |
| 2,005,443 | A | | 6/1935 | Steele |
| 2,339,790 | A | | 1/1944 | Magnus |
| 2,675,727 | A | | 4/1954 | Beker et al. |
| 3,628,242 | A | * | 12/1971 | Zollman ..... 29/622 |
| 5,182,413 | A | | 1/1993 | Epping |
| 5,367,937 | A | * | 11/1994 | Epping ..... 84/377 |
| 6,326,532 | B1 | * | 12/2001 | Antaki ..... 84/377 |
| 6,359,204 | B2 | | 3/2002 | Antaki |
| 6,635,814 | B2 | * | 10/2003 | Antaki ..... 84/377 |
| 7,247,779 | B2 | | 7/2007 | Zumsteg |
| 7,479,592 | B1 | | 1/2009 | Slavik |

FOREIGN PATENT DOCUMENTS

| | | | | |
|---|---|---|---|---|
| SU | 664987 | A | * | 5/1979 ..... 84/377 |

* cited by examiner

*Primary Examiner* — Kimberly Lockett
(74) *Attorney, Agent, or Firm* — Eckert Seamans Cherin & Mellott, LLC; Stephen A. Bucchianeri

(57) ABSTRACT

A system for altering the pitch produced by a reed of a reeded instrument. The system comprises a reed having a first portion structured to be coupled to the instrument and a second portion generally free to vibrate and a magnet adjustably disposed adjacent the reed. The reed comprises a magnetic material.

21 Claims, 16 Drawing Sheets

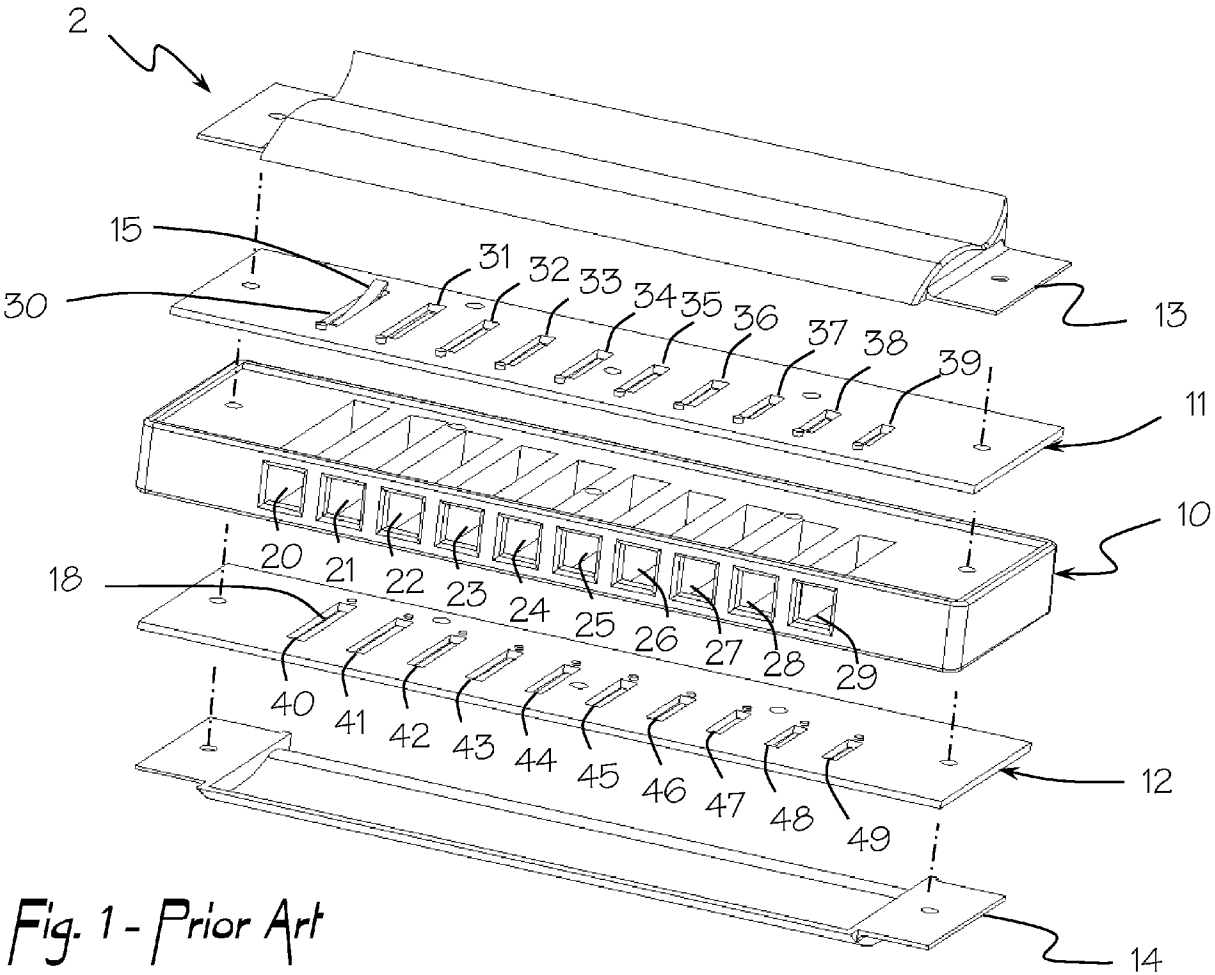
Fig. 1 - Prior Art

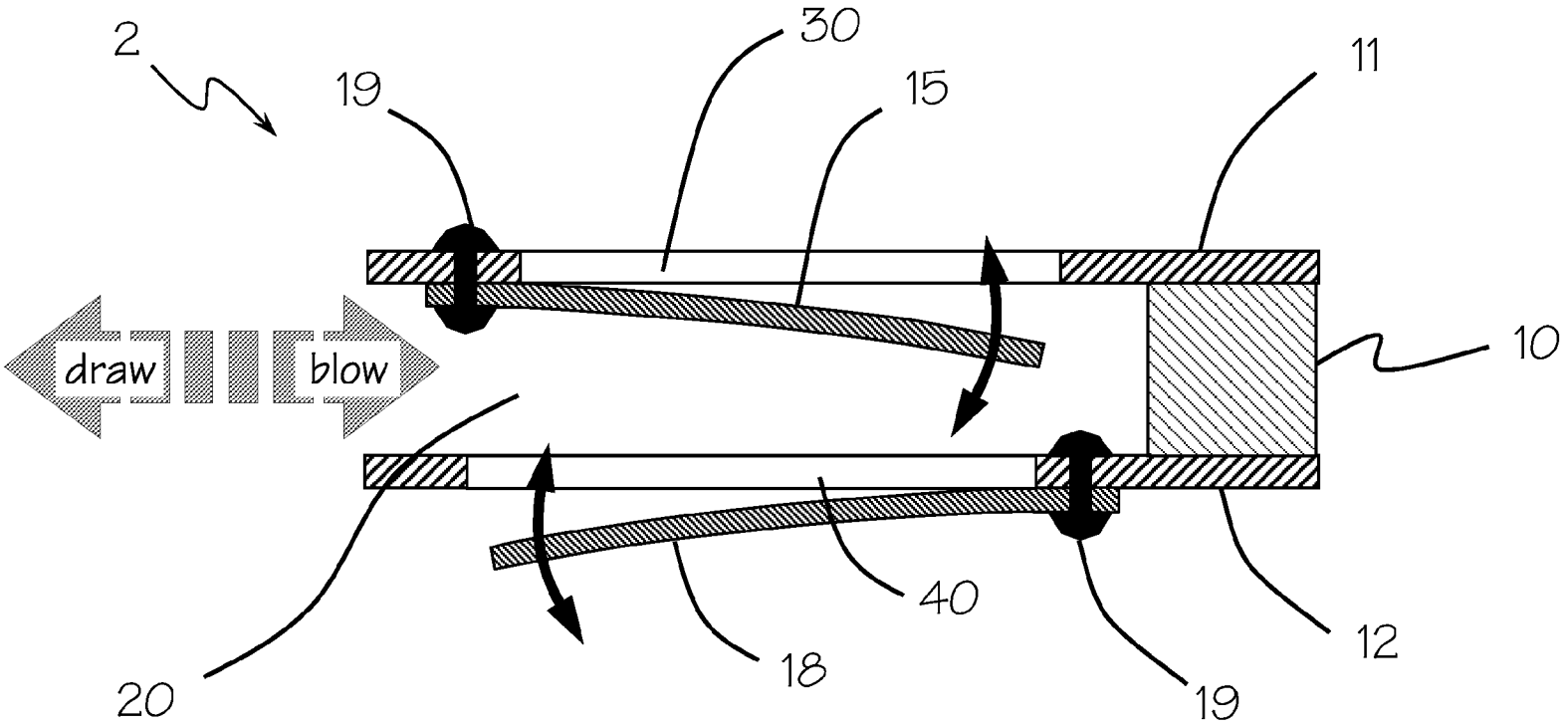
Fig. 2 - Prior Art

PITCH ALTERING MECHANISM FOR REEDED INSTRUMENT

BACKGROUND OF THE INVENTION

1. Field of the Invention

The present invention generally relates to improvements in the structure and function of a musical instrument, more particularly, the present invention relates to improvements in the structure and function of a reeded instrument, such as a harmonica.

2. Background Information

Reeded instruments, such as for example, without limitation, the saxophone, oboe, reed organ, Chinese sheng, and harmonica produce musical notes or tones generally by way of a vibrating reed. Harmonicas produce musical tones by a player blowing air into, or drawing air from, a mouthpiece in a manner that causes one or more of the reeds therein to vibrate. One popular form of the harmonica is the ten-hole diatonic harmonica, having two reeds per hole, although there are numerous variations having different numbers of holes, and reeds per hole.

As shown for example in FIG. 1, the typical construction of a diatonic harmonica includes a pair of reed plates attached to opposing faces of a comb providing ten cells. Each plate contains a set of ten flexible metallic reeds each affixed above rectangular slots through which the reeds vibrate. The reeds of each cell are configured such that one is preferably played when blowing and the other when drawing (See, FIG. 2). The Richter-tuned harmonica, the most widely known type of harmonica, is tuned such that the blow notes comprise the tonic triad (e.g. C-E-G for a harmonica tuned to the key of C) and the draw notes provide the dominant (G major) chord. Because the standard diatonic harmonica is only designed to be played in a single key at a time, diatonic harmonicas are available in all keys.

The pitch or frequency of vibration of a given reed is governed by several factors, including the reeds mass and stiffness. In general, the frequency of a given reed is proportional to the square root of the ratio of the reeds stiffness to mass.

$$\text{frequency} \propto \sqrt{\text{stiffness/mass}}$$

It is in fact common practice to tune a reed to a desired pitch by removing material from the tip, thereby reducing the mass of the reed and raising its pitch; or by removing material from the root, thereby reducing the stiffness of the reed and thus lowering its pitch.

The pitch is also related to a lesser extent by the acoustic admittance of the player's vocal tract. By modifying the vocal tract, it is possible to flatten (lower the pitch) of the greater pitched reed in a given cell. A moderately advanced diatonic harmonica player can thereby produce twelve additional tones by a process known as "bending," whereby the player modifies the resonant volume in the vocal passage, principally with the tongue, to "bend" or adjust the tone produced to achieve the desired pitch. A "bend" is therefore a procedure involving the adjustment of the player's embouchure, wherein a tone is flatted by causing the normally idle lower-pitched reed of the reed pair in a harmonica to vibrate in its opening mode.

A more advanced player can also produce four additional tones by a technique known as "overblowing," whereby the player more strictly matches the appropriate resonant volume with the tone he or she wishes to produce, typically causing the draw reed of the first, fourth, fifth, and sixth holes to produce tones corresponding to a flatted third of the low octave and a flatted third, fifth, and seventh respectively of the middle octave. Similarly, drawing and a strictly controlled shaping of the resonant passage will produce "overdraw" tones from the blow reeds corresponding to a sharped first, fifth and eighth of the highest octave. Therefore, an overblow or overdraw procedure is one in which the tone is sharped by causing the higher pitched reed in a harmonica reed pair to vibrate in its opening mode. Overblow occurs on the first six holes of a standard diatonic harmonica wherein the higher-pitched reed is the draw reed; overdraw occurs on the last four holes of a standard diatonic harmonica wherein the higher-pitched reed is the blow reed.

A problem associated with conventional harmonica play is that the player must modify his or her oral cavity to achieve certain bends, overblows, or overdraws. Low draw bends typically require excessively large embouchure, necessitating that the jaw be lowered and the tongue positioned low in the oral cavity. Conversely, overblows, blow bends, and overdraws require relatively small oral volume and that the tongue of the musician be positioned against the palate with the tip forward against the upper teeth.

In all, using the normal playing, bending, overblowing, and overdrawing techniques, the most skilled diatonic harmonica player can produce a total of thirty-eight tones from the ten-hole diatonic harmonica. The technique of overblowing is extremely difficult and diatonic harmonica players, even those of great skill, have been known to practice the technique for years before feeling comfortable enough to use the technique in a live performance. The same can be said of the "overdrawing" technique.

Furthermore, both overblow and overdraw on a diatonic harmonica causes a sudden jump in pitch, unlike the bent notes which permits a gradual transition between notes. Such sudden jump limits the expressiveness of the player.

Because the seven tones achieved by overblowing or overdrawing are not readily achieved on a ten-hole diatonic harmonica, many players resort to a chromatic harmonica, which offers a full chromatic scale of semitones by means of a slide that directs air to separate sets of reeds, each of the separate reeds being pitched a semitone higher than those activated without the slide. However, the transition between reeds on a chromatic harmonica is discrete—analogous to the keys of the piano. It is not possible to gradually alter the pitch, as would be possible for example on a slide trombone, guitar, violin, and other instruments. It is therefore impossible to induce a desirable tremolo effect, as would be possible on such aforementioned instruments.

Furthermore, the pitch produced by both the diatonic and chromatic harmonicas is relatively insensitive to the loudness of sound produced. There are however circumstances in which the modulation of pitch with loudness is desirable.

A number of devices have been used to improve the playing of harmonicas. For example, U.S. Pat. No. 574,625, discloses a siding mouthpiece for transferring a blast of air from one cell chamber to another without moving the lips. U.S. Pat. No. 1,671,309, discloses a chromatic harmonica having a frontal slide which occludes certain blow holes in the harmonica to allow the player to achieve a chromatic scale, as opposed to a diatonic scale. Other chromatic harmonicas having blow hole-occluding devices include U.S. Pat. Nos. 1,752,988; 2,005,443; 2,339,790 and 2,675,727.

U.S. Pat. No. 5,739,446 to Bahnson, discloses a harmonica and method of playing which involves the use of a valve mechanism. A sliding set of louvers is added to one side of each reed plate, which apparently, when activated, block the air leakage from the inactive reed. This mechanism appears to be relatively complicated and expensive to implement. The Bahnson harmonica also appears to require the player to activate the valve at the exact instant that the overblow note is to be played, thus requiring additional motions and interaction with the harmonica by the player, and preventing modulation of frequency as required for certain tremolo effects.

U.S. Pat. Nos. 5,182,413 & 5,367,937 to Epping discloses a harmonica that also provides gradual transition of pitch, but through the use of additional sets of reeds. To increase the musical range of the instrument, the Epping harmonica has four reeds per reed cell. Two "enabler reeds" are provided in addition to the traditional blow and draw reeds for enabling the blow and draw reeds to both be bent to lower frequencies. All four reeds have check valves which are essential for the enabler reeds to preclude unwanted sympathetic vibration in adjacent cells. This mechanism also appears to be relatively complicated and expensive to implement.

Accordingly, an advance in the art could be realized if a harmonica could be constructed which readily permits the modulation of pitch, enabling players with limited skills to achieve bent notes, and enable both advanced and novice players the ability to smoothly modulate the pitch of any one note, or combination of notes. Another significant benefit could be realized from a harmonica that is more susceptible to the techniques of bending, overblowing and/or overdrawing.

SUMMARY

In one embodiment, the invention provides a system for altering the pitch produced by a reed of a reeded instrument. The system comprises a reed having a first portion structured to be coupled to the instrument and a second portion generally free to vibrate and a magnet adjustably disposed adjacent the reed, wherein the reed comprises a magnetic material.

The magnetic material may be a paramagnetic material or a ferromagnetic material. The magnetic material may be disposed on a portion of the reed. The magnet may be disposed in a carriage that is moveable relative to the reed. The magnet may be disposed in a threaded aperture and the magnet may threadedly engage the threaded aperture. The threaded aperture may be disposed in the carriage. The magnet may be moveable among a plurality of positions whereby the reed, when caused to vibrate, produces a first musical pitch when the magnet is disposed at a first position relative to the reed, and the reed, when caused to vibrate, produces a second musical pitch when the magnet is disposed at a second position different from the first position relative to the reed. The second musical pitch may be sharped or flatted in comparison to the first musical pitch. The first portion of the reed may be coupled to a reed plate of the musical instrument by a clamping mechanism and the clamping mechanism may be adapted to move the first portion relative to the reed plate in a manner that causes the tip of the second portion to move relative to the reed plate.

In another embodiment, the invention provides a method of playing a musical instrument having a number of reeds. The method comprises producing a first musical pitch from at least one reed of the number of reeds and altering the pitch by moving a magnet with respect to the at least one reed.

Moving the magnet with respect to the at least one reed may comprise sliding a carriage member having the magnet disposed thereon. Moving the magnet with respect to the at least one reed may comprise moving the magnet within a threaded aperture.

In a further embodiment, the invention provides a method of playing a harmonica, the harmonica comprising at least one reed disposed adjacent a cell and a magnet adjustably disposed adjacent the at least one reed, the at least one reed adapted to produce a musical pitch when air is one of blown into or drawn from the cell. The method comprises blowing air into, or drawing air out of one of the number of cells in a manner that causes the at least one reed to vibrate in a manner that produces a first pitch and altering the pitch to a second pitch by moving the magnet with respect to the reed.

The second pitch may be a sharper pitch than the first pitch. The second pitch may be flatter than the first pitch. Moving the magnet with respect to the at least one reed may comprise sliding a carriage member having the magnet disposed thereon. Moving the magnet with respect to the at least one reed may comprise moving the magnet within a threaded aperture.

In yet another embodiment, the invention provides a harmonica comprising a comb defining a number of cells therein; a number of reeds, each reed of the number of reeds coupled to the comb at or about a respective one of the number of cells, at least one reed of the number of reeds comprising a magnetic material; and a number of magnets, each magnet of the number of magnets adjustably coupled to the comb at or about the at least one reed of the number of reeds.

At least one reed of the number of reeds may comprise a first portion and a second portion ending in a tip, the first portion being coupled to the comb by a clamping mechanism and the second portion being generally free to vibrate. The clamping mechanism may be adapted to move the first portion relative to the comb in a manner that causes the tip of the second portion to move relative to the comb. Each magnet of the number of magnets may be moveable among a plurality of positions, wherein the at least one reed of the number of reeds produces a first musical pitch when a respective magnet of the number of magnets is disposed at a first position relative to the reed and wherein the at least one reed of the number of reeds produces a second musical pitch when the respective magnet is disposed at a second position different from the first position relative to the at least one reed. The second musical pitch may be sharped or flatted in comparison to the first musical pitch. The number of magnets may be disposed in a carriage that is moveable relative to the comb. The carriage may comprise a number of threaded apertures and each of the number of magnets may be threadedly disposed in a respective one of the number of threaded apertures.

In yet a further embodiment, the invention provides a reed assembly having an adjustable tip gap. The assembly comprises a reed plate and a reed having a first portion and a second portion ending in a tip. The first portion is coupled to the reed plate by a clamping mechanism and the second portion is generally free to vibrate. The clamping mechanism is adapted to move the first portion relative to the reed plate in a manner that causes the tip of the second portion to move relative to the reed plate.

BRIEF DESCRIPTION OF THE DRAWINGS

A full understanding of the present concept can be gained from the following detailed description of preferred, non-limiting embodiments when read in conjunction with the accompanying drawings in which:

FIG. 1 is an exploded, isometric view of a prior art diatonic harmonica;

FIG. 2 is a sectional view of a portion of the prior art harmonica of FIG. 1;

DESCRIPTION OF THE PREFERRED EMBODIMENTS

Figure 3A:
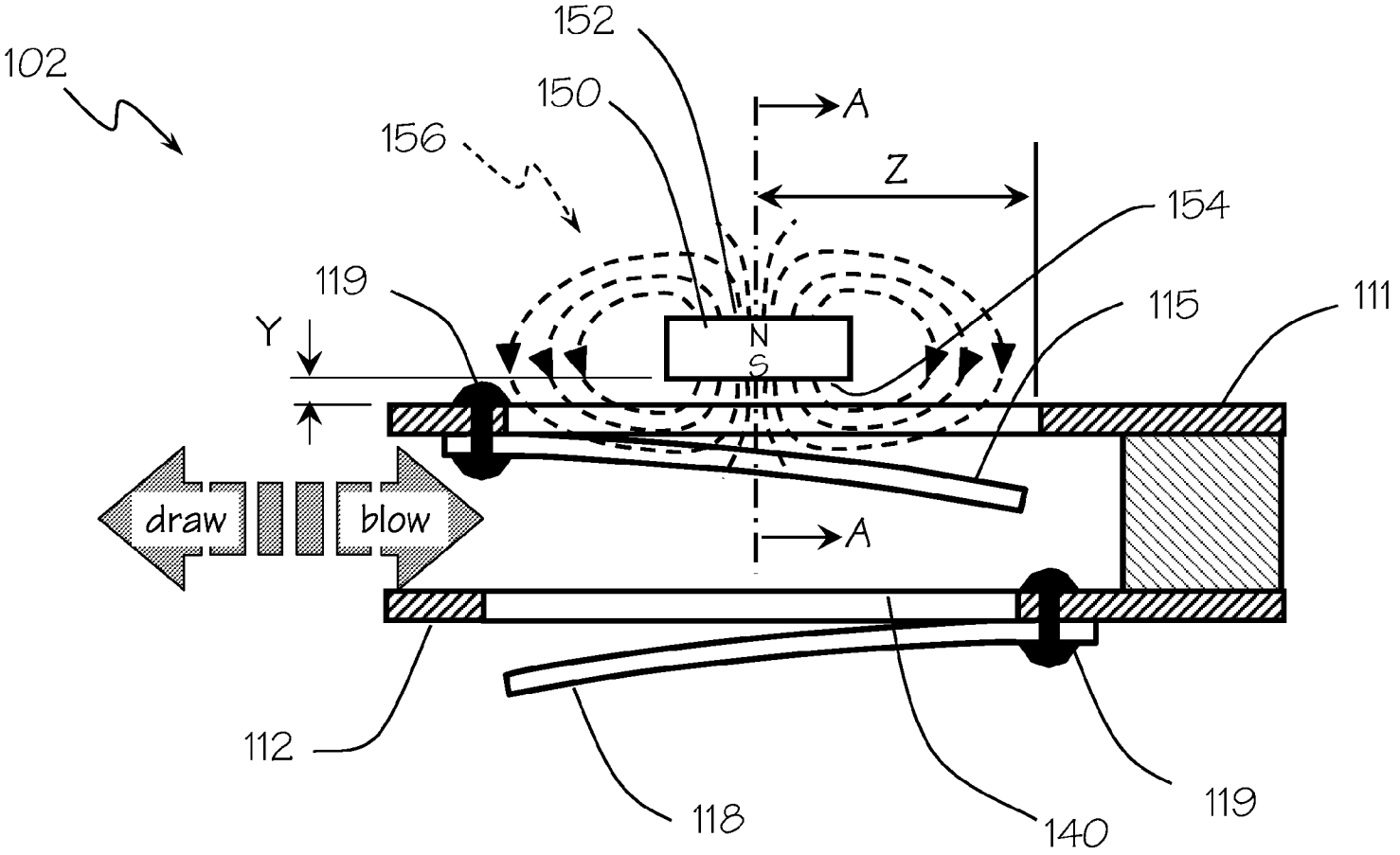
FIG. 3A is a sectional view of a harmonica in accordance with a non-limiting embodiment of the present invention illustrating a permanent magnet in proximity to one of the reeds thereof.

Referring now to FIG. 1, an example diatonic harmonica 2 is shown. As commonly known in the art, the diatonic harmonica 2 includes a body or "comb" depicted generally at 10 that is preferably fabricated of a wood, resinous plastic, metal, or other suitable material. The comb 10 is sandwiched between two reed plates 11, 12 which include a blow reed plate shown generally at 11 and a draw reed plate shown generally at 12. The reed plates 11, 12 are further sandwiched within a housing comprising an upper cover 13 and a mating lower cover 14. The reed plates 11, 12 are preferably composed of brass or other similar material suitable for use in a harmonica. It can be appreciated that the harmonica 2 can be assembled by use of conventional mechanical fasteners such as screws, bolts and the like.

As shown in FIG. 1, the blow reed plate 11 contains a plurality of slots 30-39, that each accommodate a blow reed disposed generally thereat or about, such as blow reed 15 (shown slightly flexed) in slot 30. Each of the blow reeds are mounted on the blow reed plate 11 such that when the blow reed plate 11 is positioned next to the comb 10 during assembly, each of the blow reeds seat generally inside a respective one of cells 20-29 formed within the comb 10. These cells 20-29 allow air passage into and out of the harmonica 2 by the actions of blowing and drawing, respectively. The blow reeds naturally vibrate when the harmonica player blows air into the harmonica 2.

Continuing to refer to FIG. 1, similar to blow reed plate 11, draw reed plate 12 has within it a series of draw reed slots, 40-49, each including a draw reed such as draw reed 18 therein. Unlike the blow reed mounting previously discussed, the draw reeds are mounted on the outside of the draw reed plate 12 relative to the comb 10. The draw reeds naturally vibrate when the harmonica player draws air out of the harmonica. Each blow reed, such as the blow reed 15 in blow reed slot 30, has a corresponding draw reed, such as the draw reed 18 in draw reed slot 40, positioned substantially opposite blow reed 15, such that the matched pair of reeds 15, 18 share the common cell 20. Accordingly, during harmonica play, each cell communicates with a blow reed and a draw reed as a matched pair of reeds (e.g., blow reed 15 and draw reed 18).

Referring to FIG. 2, a sectional view through one of the reed pairs of FIG. 1, such as reed pair 15,18 of cell 20, is shown. The draw reeds in positions 40-49 normally sound only when air is drawn out of the harmonica 2. This is how the diatonic harmonica 2 is designed to operate during normal play. However, it has been established that during certain procedures, known as "bends," "overblows," and "overdraws," wherein the resonance of the vocal tract is critically altered, both the draw reeds and the blow reeds can be caused to vibrate sympathetically.

Continuing to refer to FIG. 2, blow and draw reeds 15 and 18 are normally each attached by a rivet 19 or other suitable mechanical fastener to the lower surface of the respective reed plate 11, 12 so that positive air pressure applied to the cell 20 by the player (by blowing) causes blow reed 15 to close (move generally outward from cell 20 and thus upward into blow reed slot 30) while draw reed 18 is caused to open (move generally outward from cell 20 and thus downward away from draw reed slot 40). The closing action of the blow reed 15 normally results in a sustained oscillation due to the inverse relationship between the air pressure and the aerodynamic resistance across draw reed slot 30. That is, additional instantaneous air pressure causes the reed 15 to close further, thereby decreasing the clearance between the reed 15 and the blow reed plate 11, and thereby increasing the aerodynamic drag. This, in turn, causes a reduction of airflow that inevitably allows the normal elasticity of the reed 15 to reopen the slot 30. By contrast, the draw reed 18 is moved to an open position during a blowing operation, thereby decreasing its aerodynamic resistance. As such, the draw reed 18 does not support oscillation, but instead accounts for unwanted loss of air pressure. Likewise, when the player draws through passage 20, the roles of the reeds 15 and 18 are reversed.

Under certain situations, both of reeds 15 and 18 can be caused to oscillate sympathetically. This generally occurs when the player is drawing through the first six cells 20-25 of the harmonica 2 or blowing through the last four cells 26-29 of the harmonica 2. In each of these situations, the opening reed (e.g., blow reed 15) is tuned to a frequency lower than that of the closing reed (e.g., draw reed 18) in the shared, corresponding cell (e.g., cell 20 for reeds 15 and 18). Likewise, during a draw bend or blow bend procedure, the vibration of the lower-pitched opening reed increases while the vibration of the closing reed decreases.

Referring now to FIG. 3A, a section view (similar to that of FIG. 2) of an example diatonic harmonica 102 having a variable pitch feature in accordance with a non-limiting embodiment of the present invention is shown. Harmonica 102 is of generally similar construction as that of harmonica 2 previously discussed, however harmonica 102 further includes a permanent magnet 150 disposed near a blow reed 115. Similar to the conventional harmonica 2 previously discussed, blow reed 115 is attached to a reed plate 111 by a rivet 119 or other suitable mechanical fastener. In the embodiment shown in FIG. 3A, blow reed 115 is formed from a ferromagnetic or paramagnetic material such as, for example, without limitation, stainless steel. It is to be appreciated that as an alternative to forming blow reed 115 directly from a ferromagnetic or paramagnetic material, blow reed 115 may also be formed from a nonmagnetic material that includes a magnetic coating applied to at least a portion of the reed.

In the embodiment shown in FIG. 3A, magnet 150 is formed from a high energy rare earth material, such as, for example without limitation, samarium cobalt or neodymium iron boron alloy. It is to be appreciated that as an alternative to forming magnet 150 as a permanent magnet, alternative means of producing a magnetic field (e.g., without limitation, an electro-magnet) may be employed without varying from the scope of the present invention.

Permanent magnet 150 is shown having a north pole positioned at or about a top face 152 and a south pole positioned at or about a bottom face 154. The bottom face 154, and thus the south pole of magnet 150, is positioned a distance Y from the upper face of the reed plate 111, creating a magnetic field 156 in proximity to the reed 115. The magnetic field 156 (shown in dashed lines) cooperates with the paramagnetic or ferromagnetic properties of the reed 115 to create an attractive force. In a preferred embodiment the distance Y is zero, but alternative embodiments are possible in which the distance Y is non-zero. In such alternative embodiments, the distance Y is typically not larger than a few millimeters, however it is to be appreciated that greater distances may be employed without varying from the scope of the present invention.

Figure 3C:
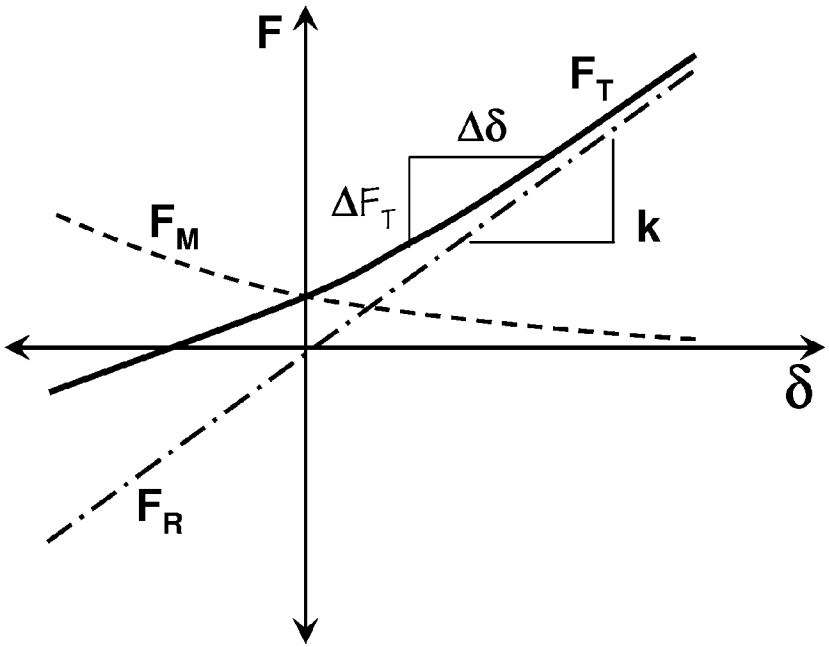
FIG. 3C is a graphical illustration of the principal forces acting on the reed of FIGS. 3A and 3B, wherein $F_R$ is the elastic force of the reed, $F_M$ is the magnetic force of the permanent magnet, $F_T$ is the total net force, and δ is the displacement of the reed from its null (resting) position.
Figure 3B:
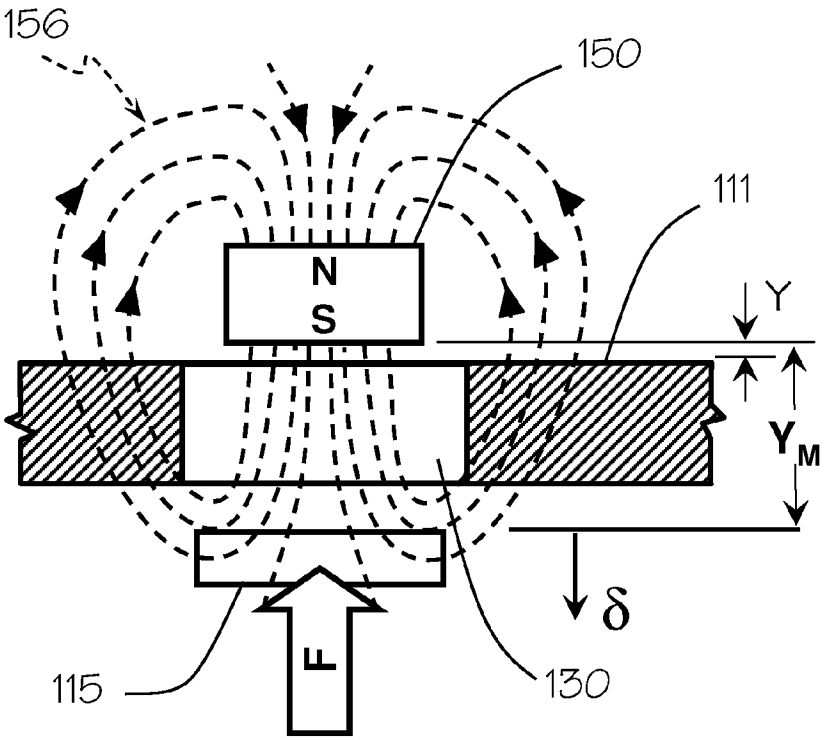
FIG. 3B is a sectional view taken along A-A of FIG. 3A of a single reed attached to a reed plate with a permanent magnet located in the "active" position, principally aligned with the reed, and with the reed located on the opposite side of the reed plate from a permanent magnet.

A non-limiting example of the physical principle by which musical pitch is altered in accordance with the present invention is illustrated in FIGS. 3B and 3C. FIG. 3B, a sectional view looking at the free end of the reed 115 of FIG. 3A, indicates the net, or total force $F_T$ acting on the reed 115, comprised of the elastic (spring) force of the reed 115 itself $F_R$ and the magnetic force between the reed 115 and magnet 150. Thus, the net force $F_T$ may be estimated according to the following equation:

$$F_T = k\delta + \frac{B^2\mu_0 A}{2Y_m^2}$$

where k is the elastic spring constant of the reed 115, δ is the displacement of the reed from its resting (equilibrium) position, B is the magnetic flux density of the magnetic field 156 produced by magnet 150, $\mu_0$ is the permeability of free space, A is the cross sectional area projected by the magnet 150 on reed 115, and $Y_m$ is the magnetic (air) gap between magnet 150 and reed 115.

It is well known that the relationship of resonant frequency of a system composed of an inertial (mass) element and an energy storage (spring) element is generally:

$$\text{frequency} \propto \sqrt{\text{stiffness/mass}}$$

It can be appreciated that a reduction of stiffness would therefore reduce the frequency of vibration of the reed 115, and hence lower (flatten) the pitch, of the system. As depicted in FIG. 3C, the net stiffness of reed 115 in turn is defined as the incremental change of total resultant force $F_T$ due to an incremental change of displacement δ. Without any magnetic field, the stiffness consisting solely of the inherent stiffness of reed 115 is relatively constant, as depicted by dot-dashed line $F_R$. The addition of magnetic field 156 from magnet 150, as depicted by dashed line $F_M$, causes the net force, depicted by solid line $F_T$ to be less steep than $F_R$, hence reducing the stiffness, and thereby the frequency of reed 115.

It can be further appreciated that the flatting effect of the force-displacement response is more pronounced for greater displacement δ of the reed 115. Therefore the pitch flattening effect will be responsive to the intensity of the sound, which is directly related to the magnitude of the displacement δ of reed 115.

Figure 3E:
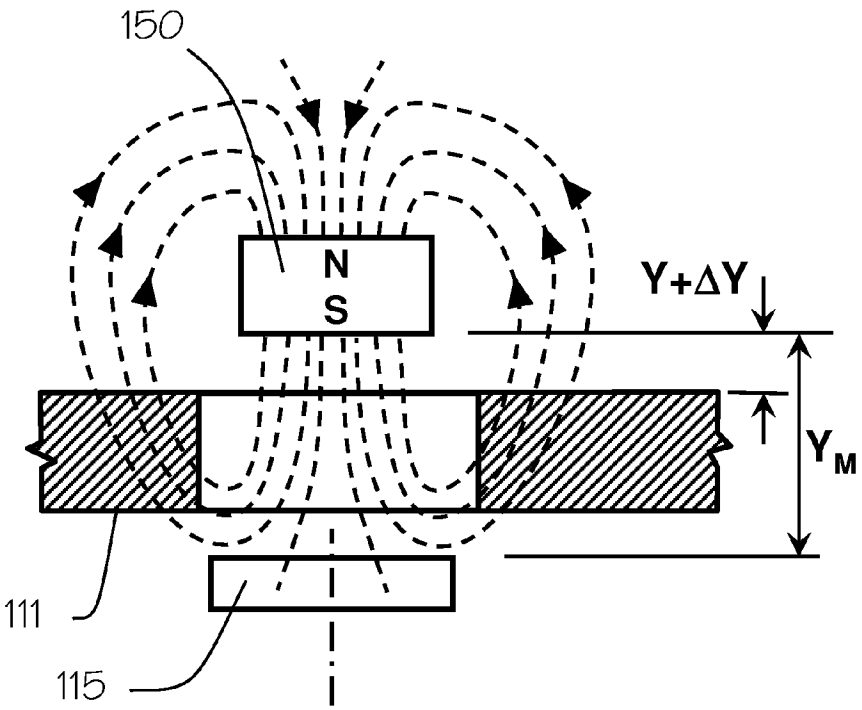
FIG. 3E is a sectional view indicating the permanent magnet of FIGS. 3A-3B displaced axially by a distance ΔY from its nominal position.
Figure 3D:
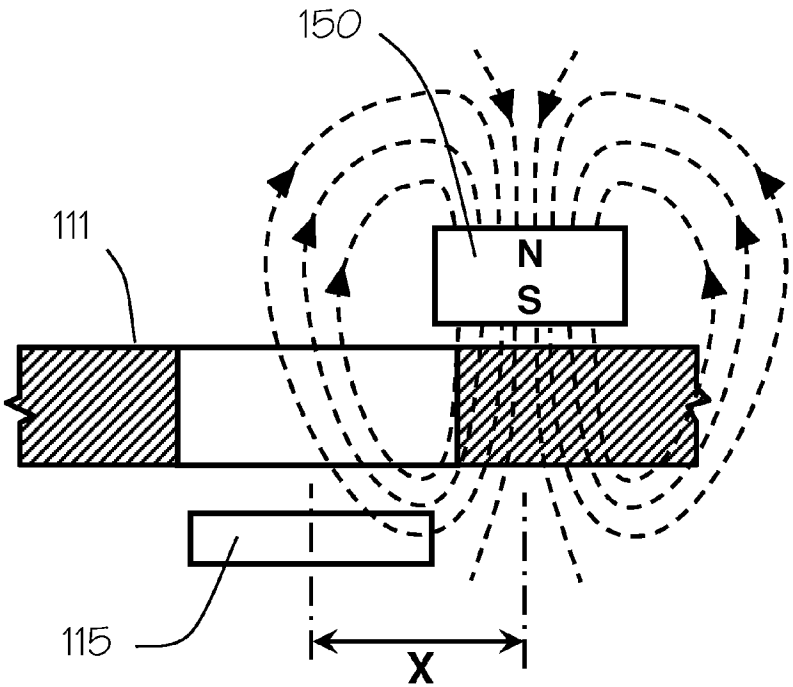
FIG. 3D is a sectional view indicating the permanent magnet of FIGS. 3A-3B displaced laterally by a distance X from the center line of the reed slot.

As shown in FIG. 3D, the magnet 150 of FIGS. 3A-3B may be positioned laterally aligned with the reed 115, or offset from the centerline of the reed 115 by a distance X. Accordingly, the projected area A between reed 115 and magnet 150 may be thereby decreased and the magnitude of magnetic force may be thereby attenuated. In a preferred embodiment, the distance X is equal to 4 mm, however it is to be readily appreciated that such distance may be readily varied dependent on the size and/or strength of the magnet used as well as properties (e.g., without limitation, size, material) of the reed used.

An alternative means of attenuating the magnetic force is provided in FIG. 3E wherein the magnet 150 of FIGS. 3A-3B may displaced axially a further distance ΔY from the reed plate (thus yielding a total distance of Y+ΔY), thereby increasing the air gap $Y_m$ between reed 115 and magnet 150. In the preferred embodiment, the distance ΔY is between 1.0 and 3.0 mm.

In contrast to the examples shown in FIGS. 3A-3B and 3D-3E in which a permanent magnet was disposed on the opposite side of the reed plate from the reed, FIGS. 4A-4B and 4D-4E show further examples of non-limiting embodiments of the present invention in which a permanent magnet and reed are disposed on the same side of the reed plate. It is to be appreciated that such arrangement can readily be created by the placement of a permanent magnet, such a magnet 160 adjacent draw reed 118, below the draw reed plate 112 of FIG. 3A, or alternatively through placement of such a magnet 160 within cell 120 adjacent blow reed 115.

Figure 4A:
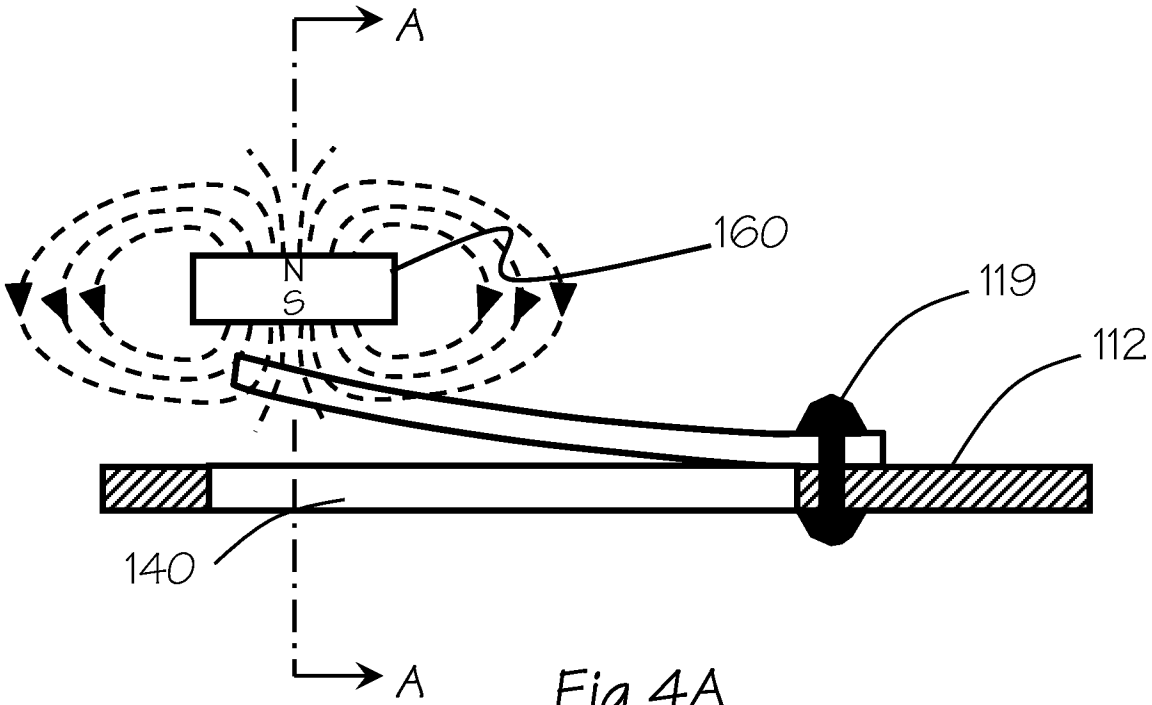
FIG. 4A is a sectional view of another non-limiting embodiment of the present invention showing one reed and reed plate with a permanent magnet located above the reed, on the same side of the reed plate.
Figure 4C:
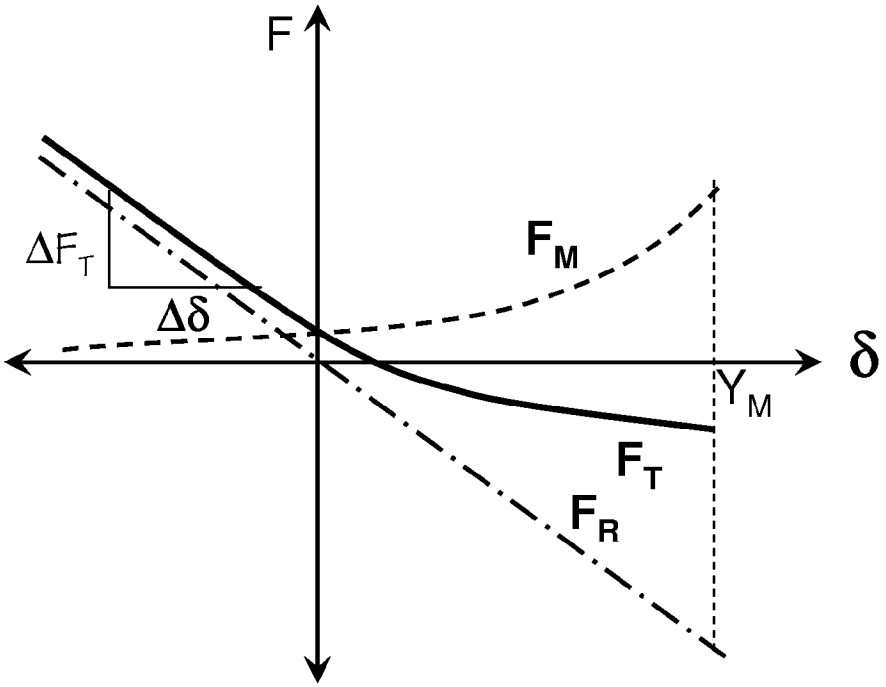
FIG. 4C is a graphical illustration of the principal forces acting on the reed of FIGS. 4A-4B, wherein $F_R$ is the elastic force of the reed, $F_M$ is the magnetic force of the permanent magnet, $F_T$ is the total net force, and δ is the displacement of the reed from its null (resting) position.
Figure 4B:
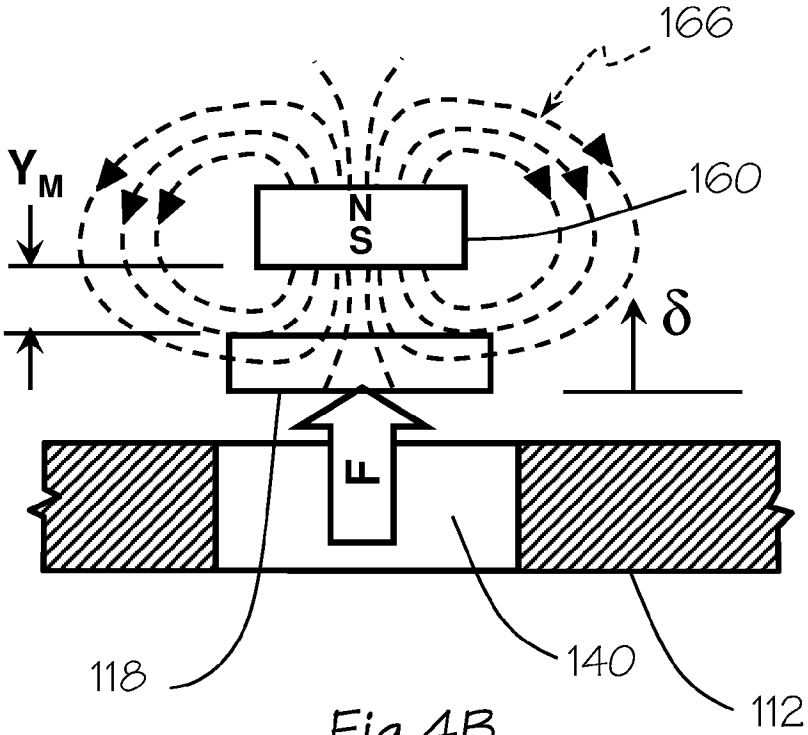
FIG. 4B is a sectional view taken along A-A of FIG. 4A of a single reed attached to a reed plate with a permanent magnet located in the "active" position, principally aligned with the reed, and with the reed located between the reed plate and a permanent magnet.

FIG. 4B, a sectional view generally of the free end of reed 118 (as indicated at section A-A of FIG. 4A), indicates the net force F acting on the reed 118, comprised of the elastic (spring) force of the reed 118 itself and the magnetic force between the reed 118 and the magnet 160. Similar to the arrangement previously discussed, the net or total force $F_T$ may be estimated according to the following equation:

$$F_T = k\delta + \frac{B^2\mu_0 A}{2Y_m^2}$$

where k is the elastic spring constant of the reed 118, δ is the displacement of the reed from its resting (equilibrium) position, B is the magnetic flux density of the magnetic field 166 produced by magnet 160, $\mu_0$ is the permeability of free space, A is the cross sectional area of the magnet 160, and $Y_m$ is the air gap between magnet 160 and reed 118. It is well known that the relationship of resonant frequency of a system composed of an inertial (mass) element and an energy storage (spring) element is:

$$\text{frequency} \propto \sqrt{\text{stiffness/mass}}$$

It can be appreciated that a reduction of stiffness would therefore reduce the frequency of vibration of the reed 118, and hence lower (flatten) the pitch, of the system. As depicted in FIG. 4C, the net stiffness of reed 118 in turn is defined as the incremental change of total resultant force $F_T$ due to an incremental change of displacement δ. Without any magnetic field, the stiffness consisting solely of the inherent stiffness of reed 118 is relatively constant, as depicted by dot-dashed line $F_R$. The addition of magnetic field 166 from magnet 160, as depicted by dashed line $F_M$, causes the net force, depicted by solid line $F_T$ to be less steep than $F_R$, hence reducing the stiffness, and thereby the frequency of reed 118.

Figure 4E:
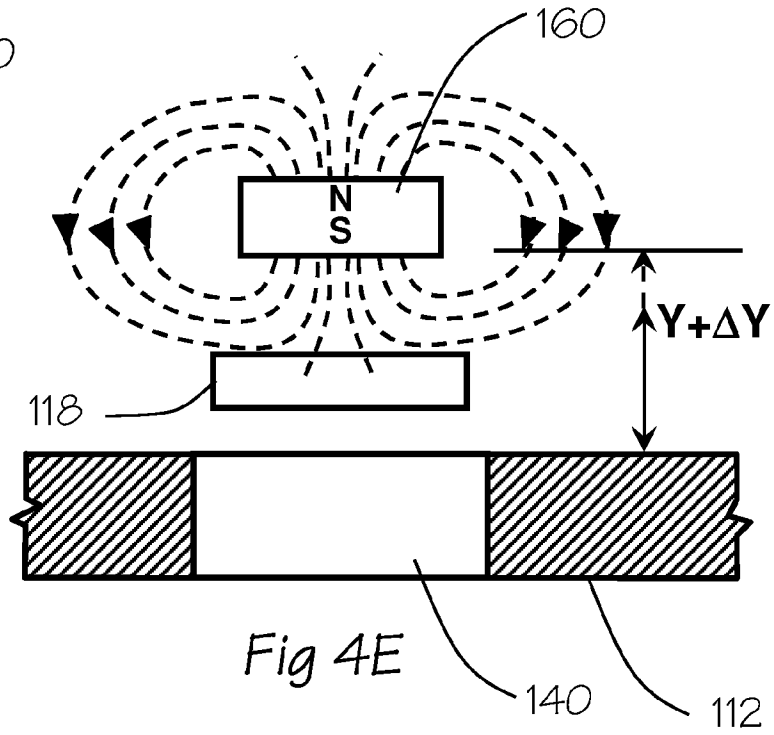
FIG. 4E is a sectional view indicating the permanent magnet of FIGS. 4A-4B displaced axially by a distance ΔY from its nominal position.
Figure 4D:
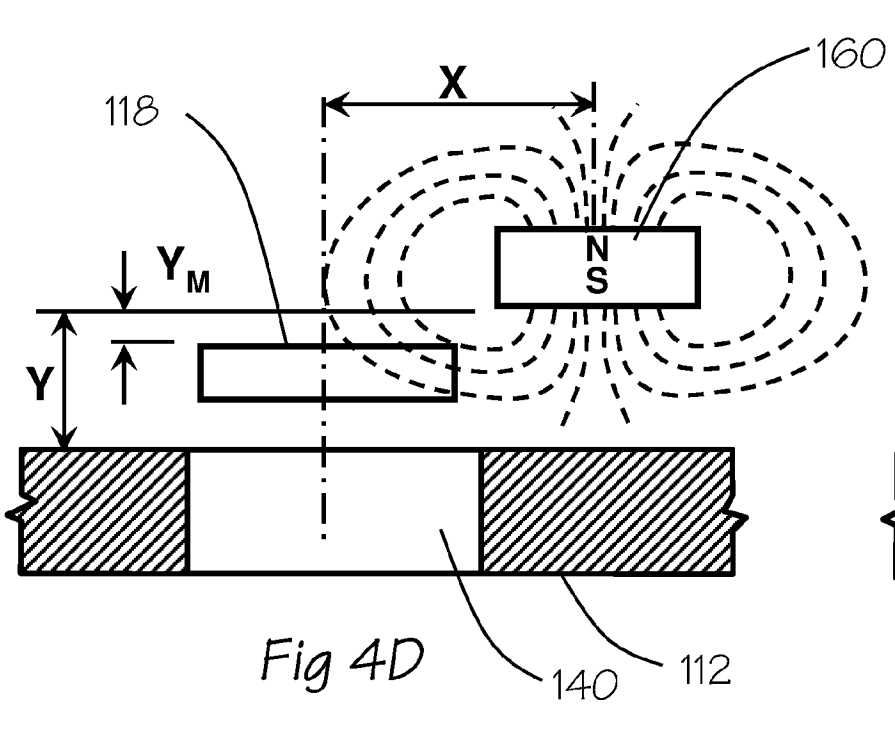
FIG. 4D is a sectional view indicating the permanent magnet of FIGS. 4A-4B displaced laterally by distance X from the center line of the reed slot.

As shown in FIG. 4D, the magnet 160 of FIGS. 4A-4B may be positioned laterally aligned with the reed 118, or offset from the centerline of the reed 118 by a distance X. Accordingly, the magnitude of magnetic force may be thereby attenuated. In a preferred embodiment, the distance X is equal to 4 mm, however it is to be readily appreciated that such distance may be readily varied dependent on the size and/or strength of the magnet used as well as properties (e.g., without limitation, size, material) of the reed used.

An alternative means of attenuating the magnetic force is provided in FIG. 4E wherein the magnet 160 of FIGS. 4A-4B is displaced axially by a further distance ΔY from the reed plate, thereby increasing the magnetic (air) gap $Y_m$ between reed 118 and magnet 160. In a preferred embodiment, the distance ΔY is between 1.0 and 3.0 mm, however it is to be appreciated that other distances may be employed without varying from the scope of the present invention.

Figure 5A:
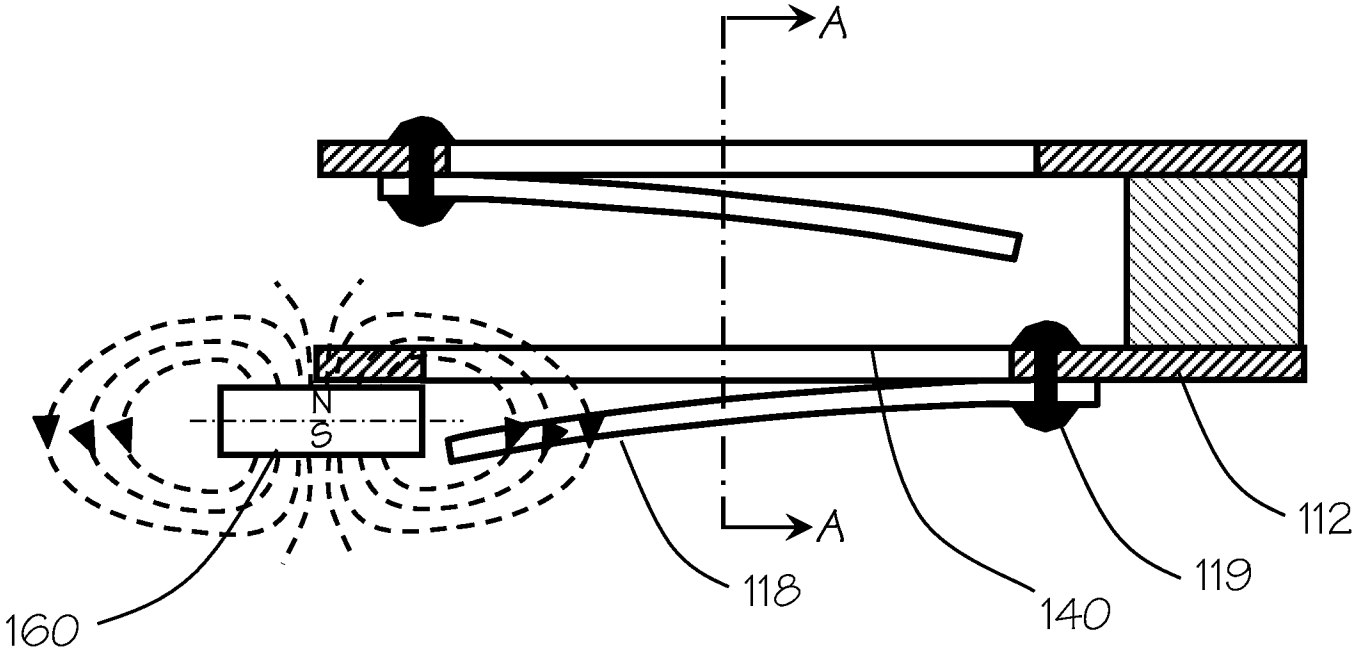
FIG. 5A is a sectional view of a further non-limiting embodiment of the present invention wherein the permanent magnet is located adjacent to the tip of the reed such that a portion of the trajectory of the reed tip passes one face of the magnet.
Figure 5C:
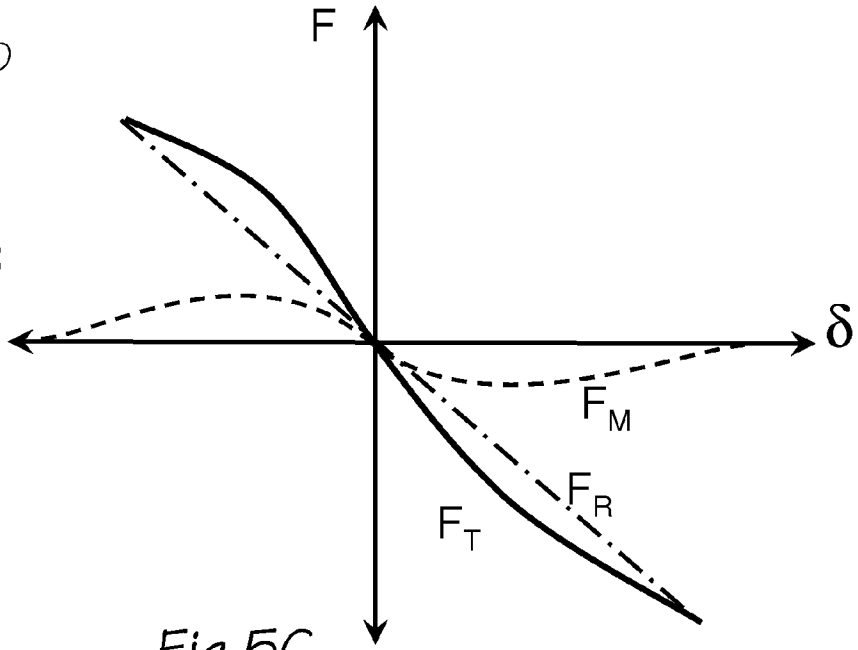
FIG. 5C is a graphical illustration of the principal forces acting on the reed of FIG. 5B, wherein $F_R$ is the elastic force of the reed, $F_M$ is the magnetic force of the permanent magnet, $F_T$ is the total net force, and δ is the displacement of the reed from its null (resting) position.
Figure 5B:
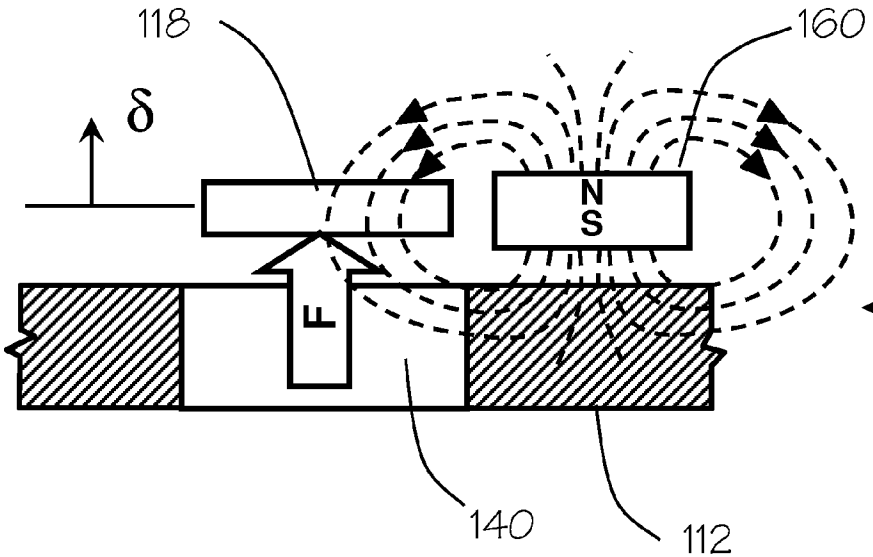
FIG. 5B is a sectional view of another embodiment of the reed-magnet pair of FIG. 5A in which the permanent magnet is located adjacent to the flank of the reed.

A further non-limiting embodiment of the present invention is provided in FIG. 5A. Here the permanent magnet 160 is disposed at a height relative to the adjacent reed plate 112 approximately equal to that of the reed 118, such that the reed 118, when in motion, passes through the centerline or null position of the magnet 160. FIG. 5B illustrates an alternative placement of the magnet 160 adjacent to the flank of the reed 118 and also disposed a height relative to the adjacent reed plate 112 such that the magnet 160 is principally aligned with the resting position of the reed 118. FIGS. 5B and 5C together illustrate the principle of operation, whereby the additional magnetic force $F_M$ due to the presence of magnet 160 serves to attract the reed 118 towards its null (resting) position thereby increasing the stiffness of the total restoring force $F_T$, thereby increasing the frequency of vibration and hence increasing or sharping the pitch of reed 118.

Figure 6B:
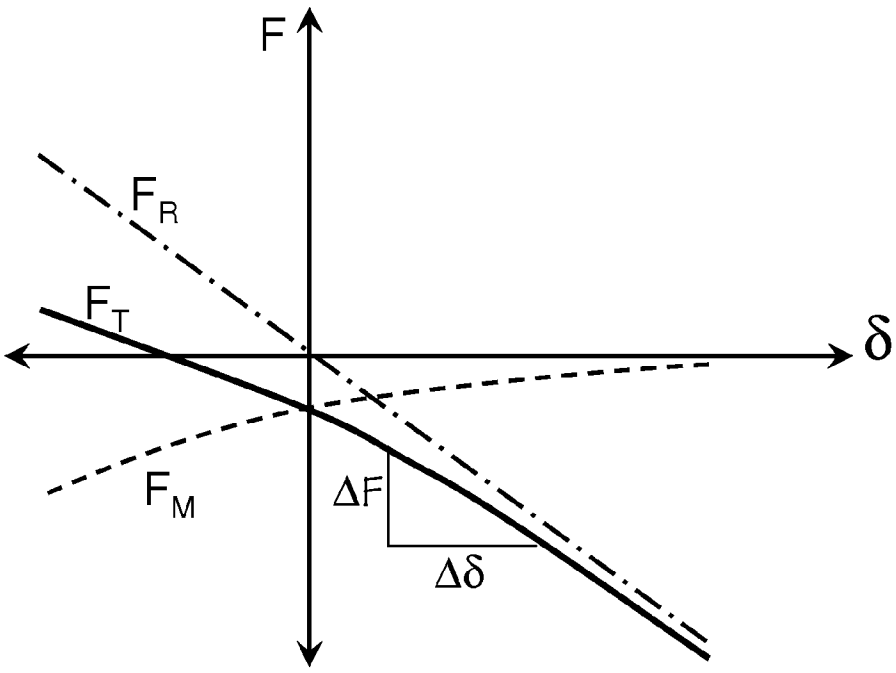
FIG. 6B is a graphical illustration of the principal forces acting on the reed of FIG. 6A.
Figure 6A:
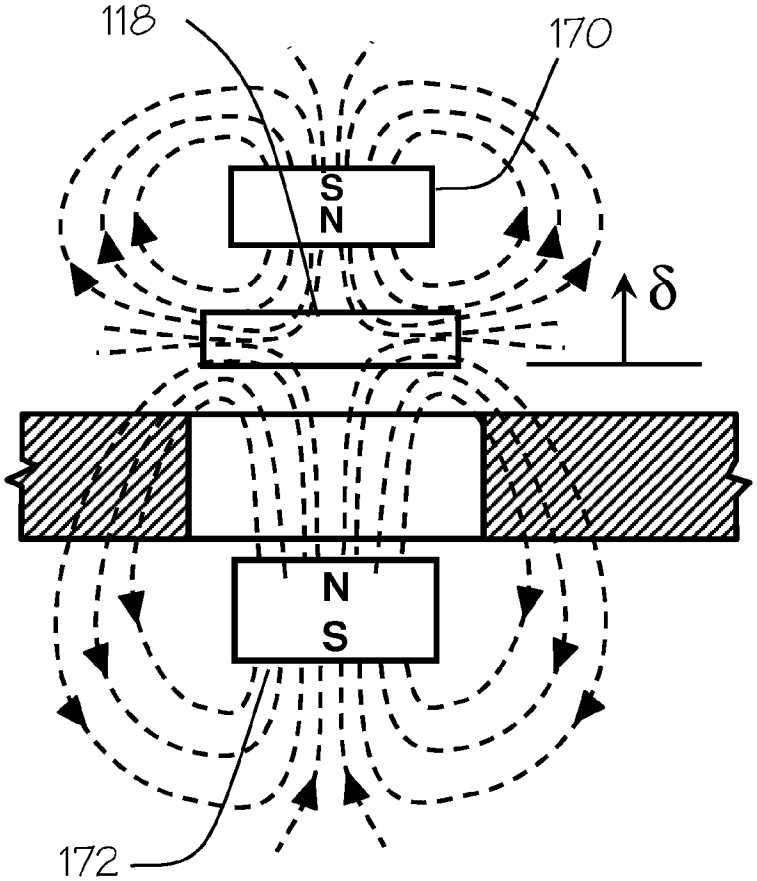
FIG. 6A is another non-limiting embodiment of the present invention in which a pair of opposed permanent magnets is provided above and below a reed.

Another non-limiting embodiment of the present invention is provided in FIG. 6A in which a pair of magnets 170, 172 are disposed on either side of a reed, such as draw reed 118. It can be readily appreciated that such combination of magnets accentuate the magnetic field gradient and hence the frequency shifting effect.

Figure 7B:
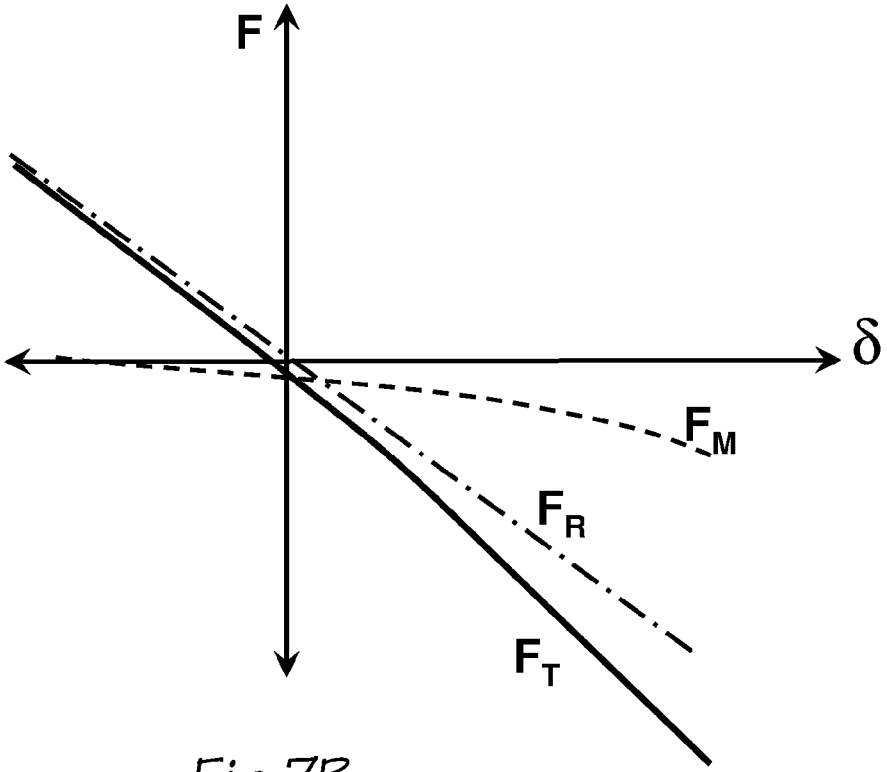
FIG. 7B is a graphical illustration of the principal forces acting on the reed of FIG. 7A.
Figure 7A:
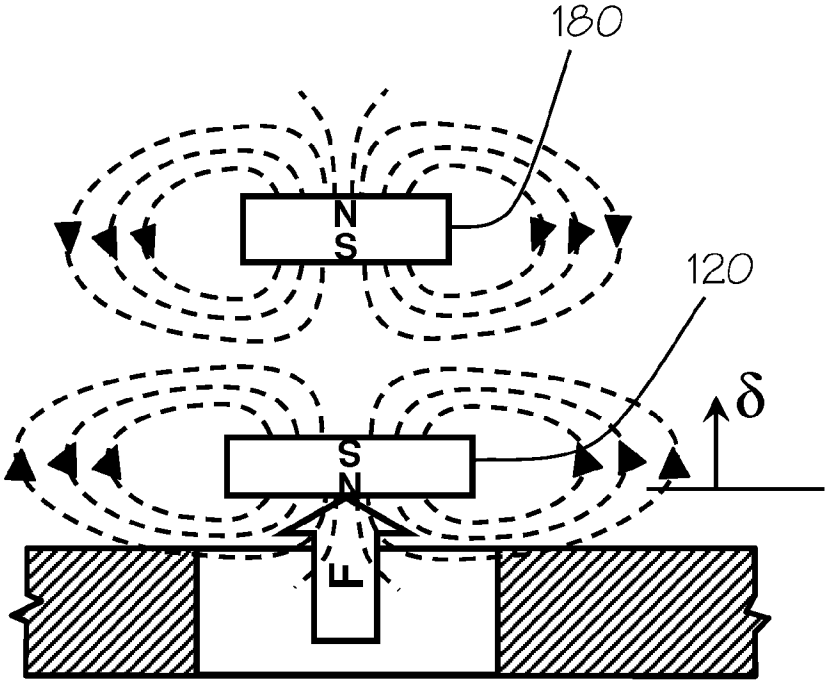
FIG. 7A is another non-limiting embodiment of the present invention wherein a reed is magnetized.

Another non-limiting embodiment of the present invention is provided in FIG. 7A in which a reed 120, such as one of reeds 115 or 118 previously discussed, itself is magnetized, and may cooperate with a second magnet 180, or a paramagnetic stator to provide a repulsive force. As depicted in FIG. 7B the addition magnetic force due to the presence of magnet 180 serves to increase the stiffness of the total restoring force $F_T$, thereby increasing the frequency of vibration and hence increasing or sharping the pitch of reed 120.

It is to be appreciated that the roles of permanent magnet and paramagnetic reed in the embodiments described herein may be reversed to provide and equivalent force therebetween, thereby producing the same effect as described herein.

Figure 8A:
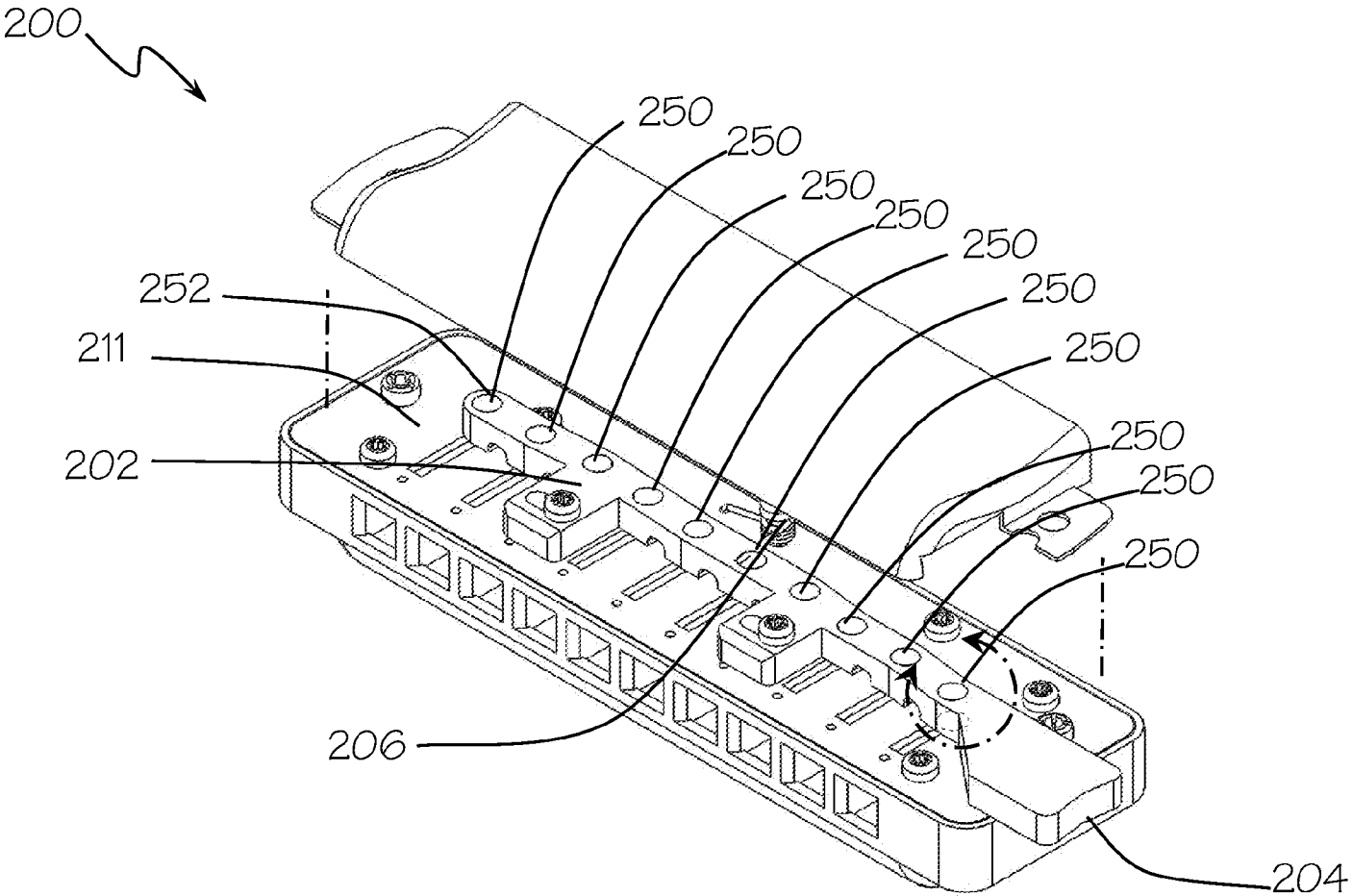
FIG. 8A is a partially exploded isometric view of a harmonica in accordance with a non-limiting embodiment of the present invention.

It is to be appreciated that a harmonica having a pitch altering system in accordance with the present invention may include any number of magnets, and a preferred embodiment provides a total of twenty magnets: one for each reed. FIG. 8A illustrates a harmonica 200 having a non-limiting example of a pitch altering system including an arrangement of 10 magnets 250, which are disposed on a carriage 202 slideably coupled to the blow reed plate 211. More particularly, each magnet 250 is disposed within a respective cavity 252 in carriage 202. In such arrangement, the player may displace the carriage 202 relative to the reed plate 211, and thus the reeds coupled thereto, by depressing an external button or protrusion 204 that is integrally formed with, or mechanically coupled to, the carriage 202. Spring member 206 serves to restore the carriage 202 to its resting "neutral" position upon release of protrusion 204. The carriage 202 may be displaced any fraction of its full travel to allow a fractional reduction of the pitch of the reeds. A tremolo effect is possible by rapid repeated depression of the button.

Figure 8B:
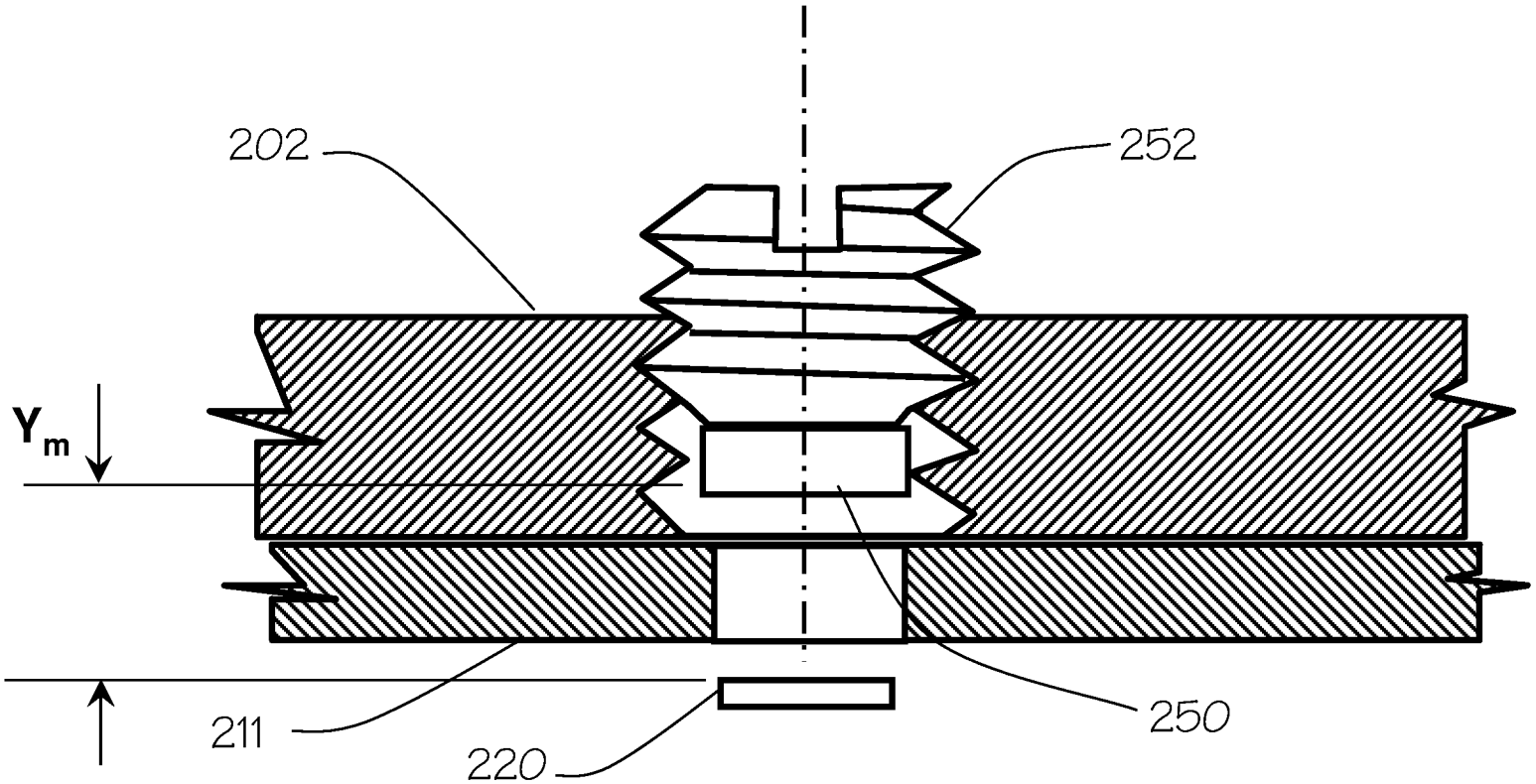
FIG. 8B is a detail cross-sectional view of a portion of the harmonica of FIG. 8A.

FIG. 8B illustrates a preferred means of adjustably coupling each of the permanent magnets 250 to the carriage 202 by means of a threaded screw 252. Each threaded screw 252 provides for initial tuning of the reed-magnet pair through adjustment of the screw which adjusts the relative positioning of the respective magnet 250 from the reed 220, as shown by the distance Y. Alternatively, each adjustment screw 252 may be directly formed from, or coated with, a magnetic material such that each adjustment screw 252 functions as a magnet in place of magnets 250.

In another non-limiting embodiment, the carriage carrying the magnets is moveable in an axial direction along the length of the reeds (e.g., Z, FIG. 3A) to achieve the same effect.

In another non-limiting embodiment, the carriage may be displaced in height from the reed plate (e.g., Y, FIG. 3E.) to achieve the same effect.

In another non-limiting embodiment, the return spring 206 of FIG. 8A is replaced by a magnet, or pair of magnets.

In yet another non-limiting embodiment, the carriage 202 of FIGS. 8A and 8B is stationary, and the adjustment screws 252 with permanent magnets 250 provide means for tuning the pitch of the reeds, thus obviating the need for any physical alteration thereto, such as filing or grinding.

The reeds of the present invention are composed of a material selected from the group of elastic paramagnetic (or ferromagnetic) metals including stainless steel and nickel-titanium alloy; however any paramagnetic or ferromagnetic material which is attractable by a magnetic field may be used. Stainless steel alloy is characterized by relatively high elasticity, corrosion resistance, and durability, and is therefore a preferred material for the reeds of the present invention.

In preferred embodiments, the permanent magnets are fabricated from neodymium iron boron alloy, however any suitable magnetic or magnetize-able material may be used to create the magnetic field, including, for example without limitation, samarium cobalt, alnico, or an electromagnet comprised of a coil of conductive wire.

Figure 9A:
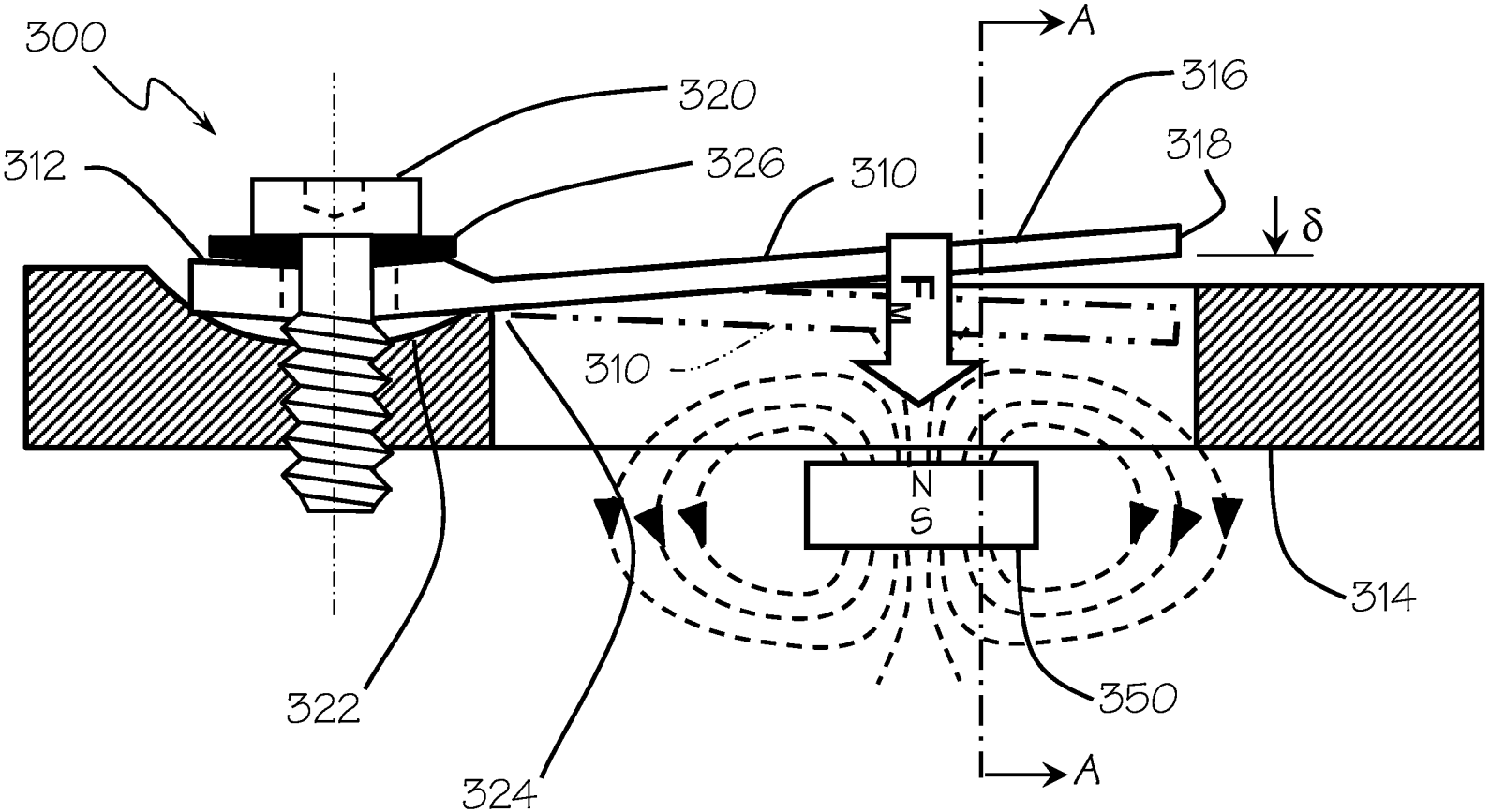
FIG. 9A is a detail cross-sectional view of a portion of a harmonica showing a reed adjustment mechanism in accordance with a non-limiting embodiment of the present invention.

FIG. 9A illustrates a further non-limiting embodiment of the present invention that includes a reed gap adjustment mechanism 300. In harmonicas the (resting) gap between the reed and the reed plate is crucial to the ability of the reed to sustain vibration. This gap is typically adjusted by manually deflecting the reed to cause a permanent (plastic) deformation. Such adjustment procedure is typically a painstaking trial-and-error process that may cause damage to the rather small, generally delicate reed. A need to adjust the tip gap generally exists both during manufacturing, and later by the musician to compensate for changes that occur as the instrument is assembled, used, and the reeds age. There is also a desire by the musician to increase or decrease the reed gap to accommodate his/her playing preference. A small gap will be more responsive due to decreased air leakage, but is more prone to "choking" when blown forcefully. A large gap will not choke, but may limit the range of pitch that may be modulated by the player's embouchure. Use of the pitch altering mechanisms described herein may also create a need to adjust the gap to counteract the effects of the associated magnet on the reeds resting position.

Referring to FIG. 9A, a reed 310 includes a first portion 312 coupled to a reed plate 314 via the adjustment mechanism 300 and a second portion 316 that ends at a tip 318 that is spaced a distance δ from the reed plate 314. Second portion 316 of reed 310 is generally flexible and free to vibrate. A threaded adjustment screw 320 couples first portion 312 of reed 310 to the reed plate 314. A cavity or recess 322 is provided within the reed plate 314 beneath the first portion 312 of the reed 310 such that at least a portion of the first portion 312 is deflected into the cavity 322 upon tightening of the adjustment screw 320. A fulcrum 324 is disposed between the first portion 312 and second portion 316 of the reed 310 such that a downward deflection of the first portion 312 results in an upward deflection of the second portion 316, thereby increasing the distance d between the tip 318 and the reed plate 314. Conversely, loosening of the adjustment screw 320 results in an upward movement of the first portion 312 and thus a downward deflection of the second portion. As shown in the illustrated example embodiment, a spherical washer 326 may be disposed between the adjustment screw 320 and the first portion 312 of the reed 310 to facilitate the bending thereof. It is to be appreciated that such adjustment mechanism 300 may be applied to any of the reeds of a harmonica, and the adjustment screw 320 may be replaced by any suitable generally equivalent adjustable clamping mechanism.

Figure 9C:
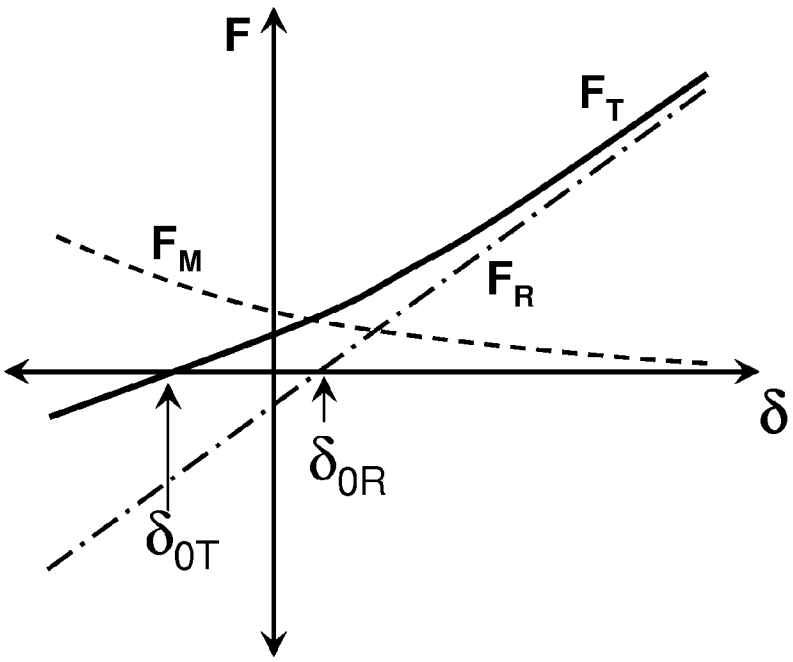
FIG. 9C is a graphical illustration of the principal forces acting on the reed of FIGS. 9A and 9B.
Figure 9B:
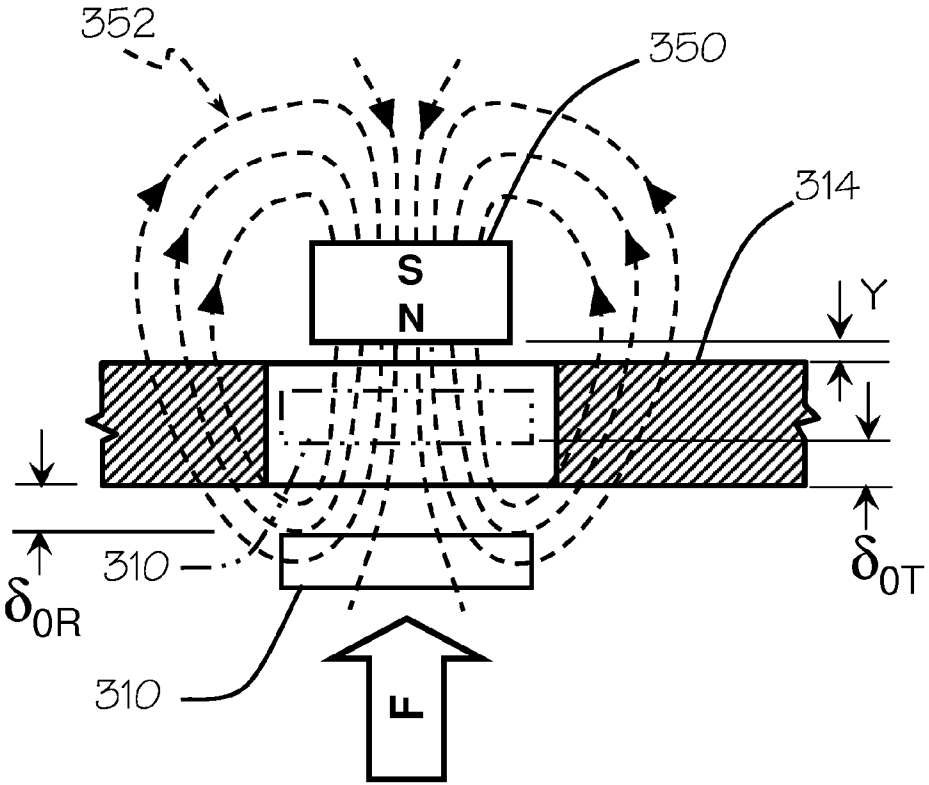
FIG. 9B is a sectional view taken along A-A of FIG. 9A.

FIGS. 9A and 9B show an example of the effect of the presence of a magnet 350 on a reed 310. The reed 310 shown in phantom line (dash-dot-dot) represents the position of reed 310 when magnet 350 is present, in contrast to solid line reed 310 which shows the resting position of reed 310 when the magnet 350 is not present. The corresponding position of the reed 310 without the presence of magnet 350 is indicated in FIG. 9C by $\delta_{0R}$ having a positive value. On the other hand, reed 310 shown in phantom line shows the resting position of reed 310 due to the presence of magnet 350 and related magnetic field 352.

In certain circumstances it is possible that the total resultant force of the magnet and the reed causes the resting position of the reed to become negative, indicated by $\delta_{0T}$ in FIG. 9C, thereby drawing the reed 310 within the reed slot, indicated by the phantom line. The position may therefore be restored to a positive value by tightening of adjustment screw 320.

It can be appreciated that the improvements described herein need not be applied to all 20 reeds, but could readily be applied to only one reed, or some other reasonable combination of reeds of a harmonica. It can also be appreciated that the principle described herein may be applied to any musical instrument or physical system that employs a vibrating reed or beam to modulate the frequency of vibration thereof.

Whereas certain terms of relative orientation such as "upper" and "lower" have been used herein to describe the invention, these terms are intended for purposes of illustration only and are not intended to limit the scope of the present invention. In addition, while specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A system for altering the pitch produced by a reed of a reeded instrument, the system comprising:

a reed having a first portion structured to be coupled to the instrument and a second portion generally free to vibrate; and a magnet disposed adjacent the reed, wherein the reed comprises a magnetic material and wherein the position of the magnet is adjustable with respect to the reed so as to selectively affect the reed in a manner which alters the pitch produced by the reed.

2. The system of claim 1 wherein the magnetic material is disposed on a portion of the reed.

3. The system of claim 1 wherein the magnet is disposed in a carriage that is moveable relative to the reed.

4. The system of claim 3 wherein the carriage comprises a threaded aperture and wherein the magnet threadedly engages the threaded aperture.

5. The system of claim 1 wherein the magnet is disposed in a threaded aperture and wherein the magnet threadedly engages the threaded aperture.

6. The system of claim 1 wherein the magnet is moveable among a plurality of positions, wherein the reed when caused to vibrate produces a first musical pitch when the magnet is disposed at a first position relative to the reed, and wherein the reed when caused to vibrate produces a second musical pitch when the magnet is disposed at a second position different from the first position relative to the reed.

7. The system of claim 6 wherein the second musical pitch is sharped or flatted in comparison to the first musical pitch.

8. The system of claim 1 wherein the first portion of the reed is coupled to a reed plate of the musical instrument by a clamping mechanism and wherein the clamping mechanism is adapted to move the first portion relative to the reed plate in a manner that causes the second portion to move relative to the reed plate.

9. A method of playing a musical instrument having a number of reeds, the method comprising:

producing a first musical pitch from at least one reed of the number of reeds; and altering the pitch by moving a magnet disposed adjacent the at least one reed with respect to the at least one reed.

10. The method of claim 9 wherein moving the magnet with respect to the at least one reed comprises one of moving the magnet within a threaded aperture or sliding a carriage member having the magnet disposed thereon.

11. A method of playing a harmonica, the harmonica comprising at least one reed disposed adjacent a cell and a magnet disposed adjacent the at least one reed, the at least one reed adapted to produce a musical pitch when air is one of blown into or drawn from the cell, the method comprising:

blowing air into, or drawing air out of one of the number of cells in a manner that causes the at least one reed to vibrate in a manner that produces a first pitch; and altering the pitch to a second pitch by moving the magnet with respect to the at least one reed.

12. The method of claim 11 wherein the second pitch is one of a sharper pitch than the first pitch or a flatter pitch than the first pitch.

13. The method of claim 11 wherein moving the magnet with respect to the at least one reed comprises sliding a carriage member having the magnet disposed thereon.

14. The method of claim 11 wherein moving the magnet with respect to the at least one reed comprises moving the magnet within a threaded aperture.

15. A harmonica comprising:

a comb defining a number of cells therein;

a number of reeds, each reed of the number of reeds coupled to the comb at or about a respective one of the number of cells, at least one reed of the number of reeds comprising a magnetic material; and a number of magnets, each magnet of the number of magnets adjustably coupled to the comb at or about a respective reed of the number of reeds in a manner such that the pitch of the at least one reed may be adjusted by adjusting the position of the magnet disposed at or about the at least one reed with respect to the at least one reed.

16. The harmonica of claim 15 wherein at least one reed of the number of reeds comprises a first portion and a second portion ending in a tip, the first portion being coupled to the comb by a clamping mechanism and the second portion being generally free to vibrate and wherein the clamping mechanism is adapted to move the first portion relative to the comb in a manner that causes the tip of the second portion to move relative to the comb.

17. The harmonica of claim 15 wherein each magnet of the number of magnets is moveable among a plurality of positions, wherein the at least one reed of the number of reeds produces a first musical pitch when a respective magnet of the number of magnets is disposed at a first position relative to the reed, and wherein the at least one reed of the number of reeds produces a second musical pitch when the respective magnet is disposed at a second position different from the first position relative to the at least one reed.

18. The harmonica of claim 17 wherein the second musical pitch is sharped or flatted in comparison to the first musical pitch.

19. The harmonica of claim system of claim 18 wherein the number of magnets are disposed in a carriage that is moveable relative to the comb.

20. The harmonica of claim 19 wherein the carriage comprises a number of threaded apertures and wherein each of the number of magnets is threadedly disposed in a respective one of the number of threaded apertures.

21. A reed assembly having an adjustable tip gap, the assembly comprising:

a reed plate; and a reed having a first portion and a second portion ending in a tip, the first portion being coupled to the reed plate by a clamping mechanism and the second portion being generally free to vibrate, wherein the clamping mechanism is adapted to move the first portion relative to the reed plate in a manner that causes the tip of the second portion to move relative to the reed plate.

* * * * *